US005771508A

United States Patent [19]

Messina

[11] Patent Number: 5,771,508

[45] Date of Patent: Jun. 30, 1998

[54] VARIABLE-POSITION HEADBOARD FOR BEDS, EASY CHAIRS AND THE LIKE

[75] Inventor: Rosario Messina, Seregno, Italy

[73] Assignee: FLOU S.p.A., Meda, Italy

[21] Appl. No.: 831,142

[22] Filed: Apr. 1, 1997

[30] Foreign Application Priority Data

Apr. 17, 1996 [IT] Italy ..... MI96U0295

[51] Int. Cl.[6] ..... A47C 20/04

[52] U.S. Cl. ..... 5/53.2; 5/634

[58] Field of Search ..... 5/53.2, 53.1, 53.3, 5/634

[56] References Cited

U.S. PATENT DOCUMENTS

| | | | |
|---|---|---|---|
| 3,790,973 | 2/1974 | Bradley | 5/53.2 |
| 4,628,552 | 12/1986 | Magistretti | 5/53.2 |
| 5,353,450 | 10/1994 | Katan | 5/53.2 |

FOREIGN PATENT DOCUMENTS

| | | | |
|---|---|---|---|
| 39 28 005 | 3/1991 | Germany | 5/634 |
| 739389 | 10/1955 | United Kingdom | 5/634 |
| 2094138 | 9/1982 | United Kingdom | 5/634 |
| 2 183 469 | 6/1987 | United Kingdom | 5/634 |

*Primary Examiner*—Alexander Grosz
*Attorney, Agent, or Firm*—Herbert Dubno; Yury Kateshov

[57] ABSTRACT

A movable headboard for beds, easy chairs and the like has at least one fixed bottom vertical surface joined to the base of the bed and at least one movable top surface hinging on the fixed bottom surface by means of a hinging device so as to be brought from a vertical position which is substantially coplanar with the bottom surface into a position in which the top surface is advanced and inclined with respect to the fixed surface.

4 Claims, 2 Drawing Sheets

VARIABLE-POSITION HEADBOARD FOR BEDS, EASY CHAIRS AND THE LIKE

FIELD OF THE INVENTION

The present invention relates to a variable-position headboard for beds, easy chairs and the like, which comprises at least one fixed bottom part and at least one top part movable with respect to thee bottom part from a position in which the top part is aligned in the same vertical plane with the bottom part into a position in which the top part is displaced forward and inclined with respect to the vertical part so as to allow a user to rest his/her back.

BACKGROUND OF THE INVENTION

It is known that normal beds and easy chairs are generally provided with a flat vertical headboard or backrest for preventing the user's head making direct contact with the wall next to which the bed is usually arranged.

Such headboard has a generally ridged form and does not allow the user to rest his/her back comfortably when in a potion other than the prone position. Thus any other position of the top part is either unobtainable or uncomfortable.

It is known to provide a device for moving headboards and/or backrests, which is designed to bring part of the headboard itself into an inclined position so that the user can be supported more comfortably when she is in the seating position.

The mechanisms of the known type have, however, drawbacks due to the complexity of their structure and due to the fact that one is required to make the movable part of the headboard perform complicated movements in order to keep the bottom part of the headboard on the mattress when the headboard is inclined forwards.

OBJECTS OF THE INVENTION

It is therefore a principal object of the invention to provide a headboard which can be arranged in an inclined position so as to allow the user to rest his/her back when not in the prone position.

Still a further object is to provide the headboard with an operating mechanism which has a simple and reliable construction and which is stably inserted in the upholstery of the headboard.

SUMMARY OF THE INVENTION

These objects are achieved by the present invention which provides a headboard for beds or the like, comprising at least two surfaces arranged one above the other and connected by hinged parallelograms by means of which the movable top part of the headboard may be displaced forwards and inclined backwards with respect to the fixed bottom part, so as to allow the user to rest comfortably.

According to the invention, the parallelogram hinging means is hinged on horizontal axes and has one of the two short sides fixed to the bottom surface of the headboard and the other short side joined to the movable top surface of the headboard, while the long sides are hinged on the short sides and transversely connected by stiffening bars.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
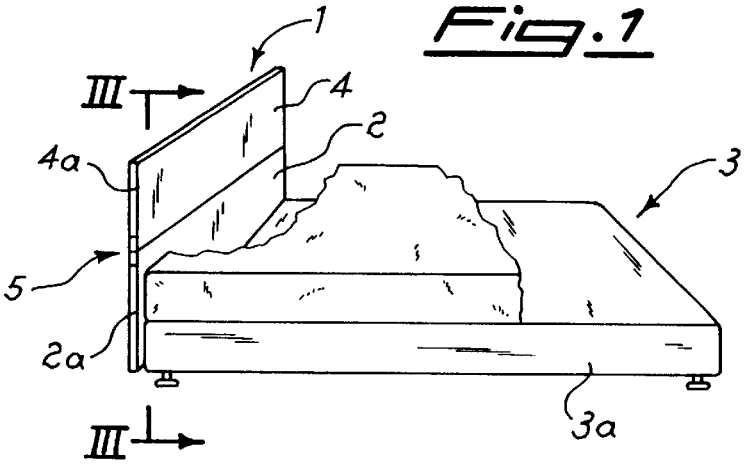
FIG. 1 is a perspective view of the bed with the hinged headboard according to the invention.

As illustrated by the Figures, the headboard 1 according to the invention comprises a fixed bottom vertical surface 2, joined to the base 3*a* of the bed 3, and a movable top surface 4 connected to the bottom surface 2 by a hinging means 5 such as, for example, a pair of hinged parallelogams arranged at the opposite vertical edges 2*a* and 4*a* of the respective surfaces 2 and 4.

The hinged parallelogram 5 has the two short sides formed by two plates 5*a* each joined to the two surfaces, i.e. the fixed bottom surface 2 and the movable top surface 4.

Figure 2:
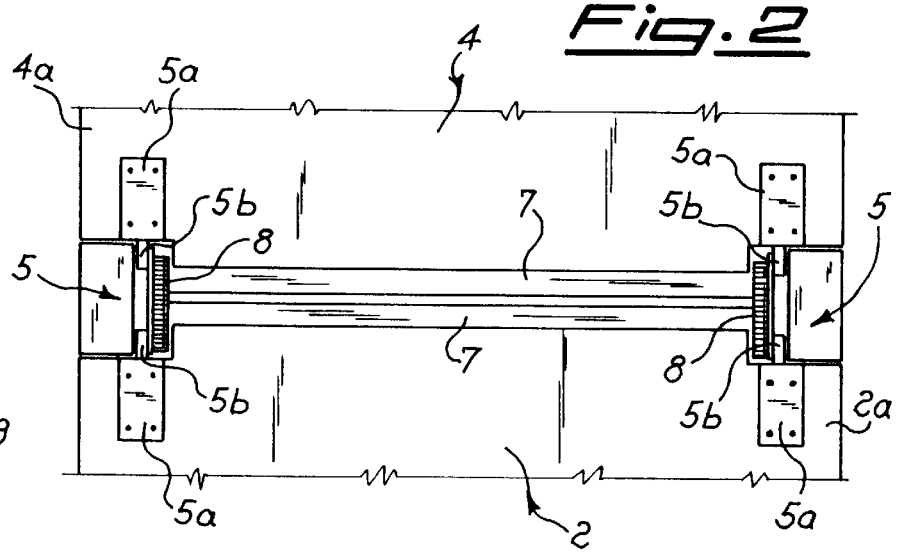
FIG. 2 is a rear elevation view of the headboard according to FIG. 1.

The plates 5*a* are provided with pairs of pins 5*b* which have hinged on them the long sides of the parallelograms 5 each of which consists of a pair of rods 5*c* and 5*d* connected together in the transverse direction by stiffening bars 7 (FIG. 2) extending over the entire width of the fixed surface 2 and movable surface 4.

Operation of the headboard is as follows: when the two surfaces 2 and 4 of the headboard 5 are arranged in the vertical position (FIG. 3), the long sides 5*c* and 5*d* of the hinged parallelogram 5 are substantially parallel and are in contact with one another, in the vertical position. When the top surface 4 is displaced forwards (FIG. 5) by the user, the two long sides 5*c*, 5*d* are arranged in a substantially horizontal position and again are in contact so as to stop the movement of the movable surface.

Figure 3:
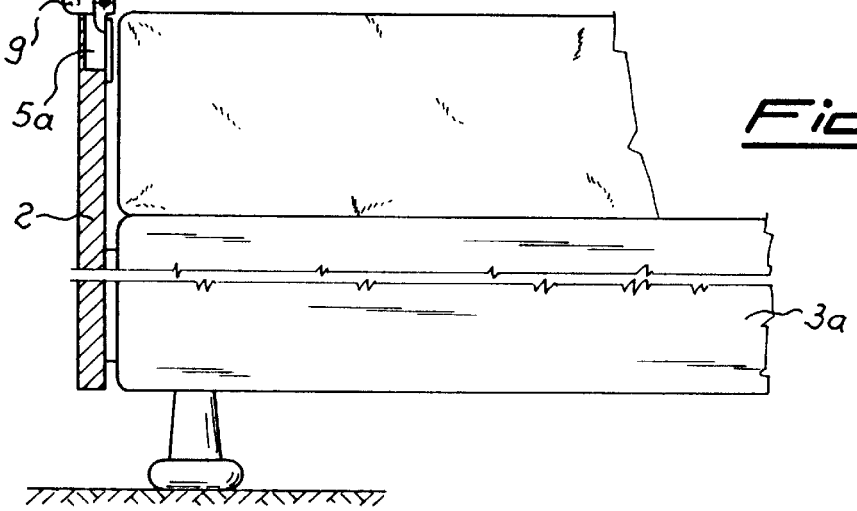
FIG. 3 is a cross-sectional view along the plane indicated by III—III in FIG. 1.
Figure 4:
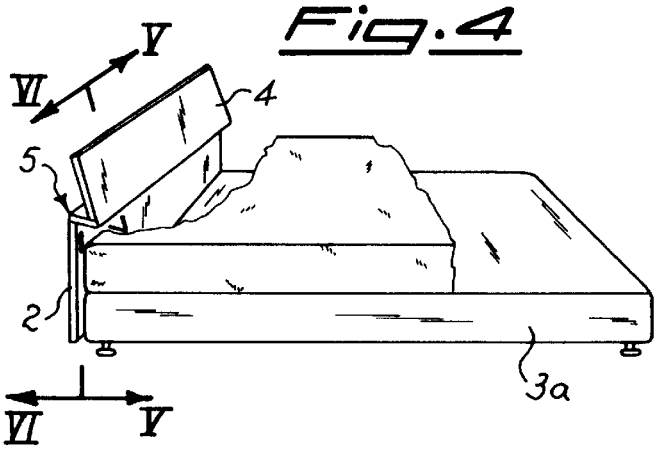
FIG. 4 is a perspective view of the bed with a part of the headboard displaced forwards.
Figure 5:
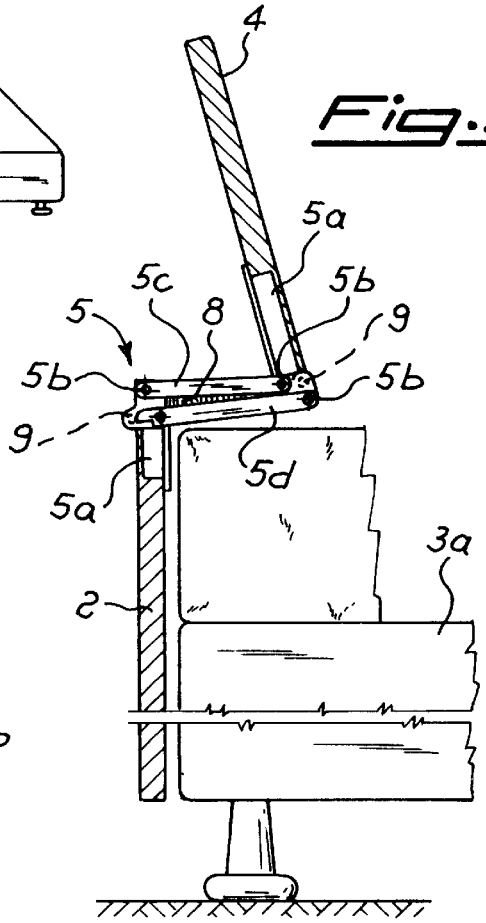
FIG. 5 is a cross-sectional view along the plane indicated by V—V in FIG. 4.

During the displacement from the position shown in FIG. 3 where the surfaces 2 and 4 are aligned in a vertical plane into the position shown in FIG. 5 where the top part 4 is displaced forwards, the hinged parallelogram 5 causes a backwards inclination of the movable part 4 over rotational pins 56 during the forward displacement of the movable surface 4. When the displacement has been completed, the movable part 4 of the backrest is arranged at a predetermined angle with respect to the part 2, thus forming a comfortable support for the back of the user.

Figure 6:
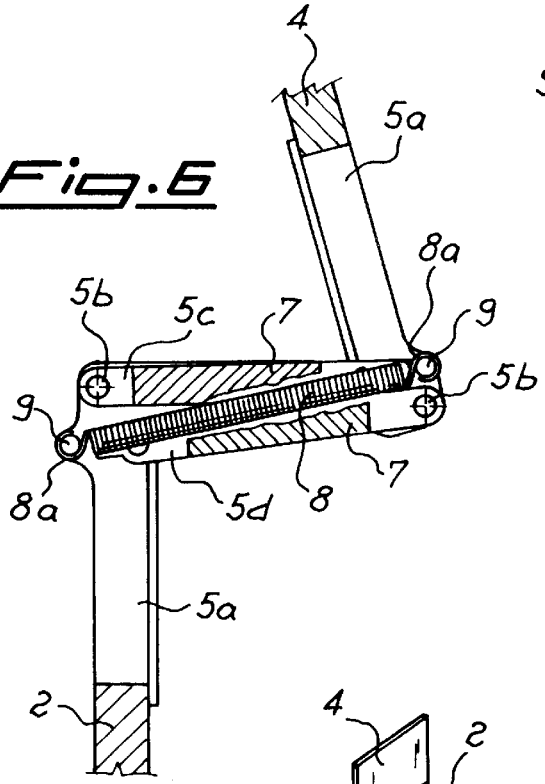
FIG. 6 is a cross-sectional view along the plane indicated by VI—VI in FIG. 4.

As illustrated in FIG. 6, the parallelogram may be balanced by means of a spring 8, the opposite ends of which have hooks 8*a* for attaching the spring to respective pins 9 integral with the top surface and the bottom surface.

Figure 7:
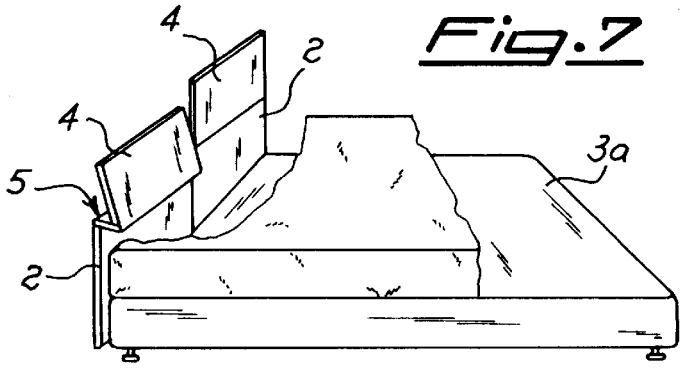
FIG. 7 is an application of the headboard according to the invention to a double bed shown in perspective.

FIG. 7, finally, illustrates the application of the headboard according to the present invention to a double bed. In this case it is possible to lower part of the headboard, keeping the other part erect in the vertical position.

I claim:

1. An adjustable headboard for a piece of furniture, comprising:

a fixed bottom panel;

at least one top panel mounted on the bottom panel for supporting the head of a user;

at least one pair of elongated rods each hingedly mounted by a respective pair of opposite ends thereof on the top and bottom panels and guiding the top panel between a first position wherein the top and bottom panels are coplanar in a vertical plane and a second position wherein the top panel is inclined with respect to a vertical;

a pair of spaced apart pins each operatively connected with one of said panels and extending transversely thereto, and a tension spring engaging the pair of pins at opposite ends of the spring and securing the top panel in the first and second positions.

2. The headboard defined in claims 1, further comprising a pair of top and bottom plates mounted fixedly on the top and bottom panels respectively and operatively connected with said rods, each of the rods being hingedly mounted by respective opposite ends to the top and bottom plates to pivot at the respective ends connected to the bottom plate from a vertical position wherein the rods extend vertically generally parallel to one another to an inclined position wherein the rods form an angle therebetween.

3. The headboard defined in claim 1, further comprising another pair of elongated rods spaced horizontally from the one pair of rods and a pair of stiffening bars connecting the rods of said one and said other pair of rods.

4. An adjustable headboard for a piece of furniture, comprising:

a bottom panel mounted fixedly on a piece of furniture;

at least one top panel mounted on the bottom panel for supporting the head of a user; and hinge means for displacing the top panel between a vertical position wherein the top and bottom panels are coplanar and aligned in a vertical plane and an inclined position wherein the top panel is inclined with respect to a vertical, the hinge means including:

a pair of four-point linkages mounted spaced apart and operatively connecting the bottom and top panels, each of the linkages comprising:

respective top and bottom plates mounted fixedly on the top and bottom panels respectively and coplanar in the vertical position of the top panel, respective first and second rods pivotally mounted by respective opposite top and lower ends thereof to the top and bottom plates, the rods being pivotal about respective lower ends from a first position wherein the rods extend generally vertically parallel to one another to a second position wherein the rods form an angle therebetween, a respective pair of pins, each one of the pair of pins being formed on the respective plate and extending thereof perpendicular to the vertical, and a respective spring hooked up on the pair of pins by opposite ends of the spring and securing the rods in said first and second positions upon displacing the top panel; and means for connecting the pair of linkages.

* * * * *